US008057327B2

(12) United States Patent
Todd

(10) Patent No.: US 8,057,327 B2
(45) Date of Patent: Nov. 15, 2011

(54) METHOD OF CUSTOM FITTING A GOLF CLUB OR LIKE GAME IMPLEMENT

(76) Inventor: Mathew Todd, Visalia, CA (US)

( * ) Notice: Subject to any disclaimer, the term of this patent is extended or adjusted under 35 U.S.C. 154(b) by 282 days.

(21) Appl. No.: 12/577,713

(22) Filed: Oct. 12, 2009

(65) Prior Publication Data

US 2011/0086731 A1 Apr. 14, 2011

(51) Int. Cl.
*A63B 57/00* (2006.01)

(52) U.S. Cl. ..... 473/409; 473/226; 473/263

(58) Field of Classification Search ..... 473/263, 473/409, 559–563, 266, 278, 251, 150, 173, 473/223, 225, 226, 262; 73/1.75, 1.81
See application file for complete search history.

(56) References Cited

U.S. PATENT DOCUMENTS 3,822,477 A * 7/1974 Collins ..... 33/508
3,874,673 A * 4/1975 Beard ..... 473/262
4,104,802 A * 8/1978 Johnston ..... 33/508
5,513,842 A * 5/1996 Fuss ..... 473/263
5,911,636 A * 6/1999 Schmoll ..... 473/266
7,083,524 B2 * 8/2006 Daniels ..... 473/201
7,172,513 B1 * 2/2007 Rinker ..... 473/219
7,195,565 B2 * 3/2007 White et al. ..... 473/296
2001/0031667 A1 * 10/2001 Shiraishi ..... 473/287
2002/0010033 A1 * 1/2002 Aoki et al. ..... 473/219
2002/0157270 A1 * 10/2002 Maraschiello ..... 33/508
2010/0004074 A1 * 1/2010 Turner ..... 473/409

* cited by examiner

*Primary Examiner* — Stephen L. Blau
(74) *Attorney, Agent, or Firm* — Richard A. Ryan

(57) ABSTRACT

A method of custom fitting a golf club or like implements having a shaft and a club head at a lower end thereof. The method utilizes the centerline of the shaft to determine the proper lie angle and true playing length for the shaft. A pointing device is attached to the shaft such that a projected point thereof is aligned with the centerline of the shaft to extend the centerline to the sole of the club head. The club head is placed on a universal setup mat with the club face aligned with the baseline thereof and the projected point on a target line where the sweet spot of the club head should hit a ball. A lie angle protractor on the mat is folded upward so the lie angle can be read from the protractor. The method also determines the proper grip size for the handle of the shaft.

19 Claims, 8 Drawing Sheets

90

RECOMMENDED PUTTER GRIP MODEL CHART

| NUMBER | LAMKIN |
|---|---|
| 1 & UNDER | CROSSLINE PISTOL |
| 2 | CROSSLINE PISTOL OR CROSSLINE PADDLE |
| 3 | CROSSLINE PADDLE |
| 4 | CROSSLINE PADDLE OR DEEP ETCH |
| 5 & OVER | DEEP ETCH |

88

92

METHOD OF CUSTOM FITTING A GOLF CLUB OR LIKE GAME IMPLEMENT

CROSS-REFERENCE TO RELATED APPLICATIONS

None.

STATEMENT REGARDING FEDERALLY SPONSORED RESEARCH

Not Applicable.

BACKGROUND OF THE INVENTION

A. Field of the Invention

The present invention relates generally to golf clubs that are utilized in the game of golf and to similarly configured game playing implements. In particular, the present invention relates to methods of sizing game implements having a shaft with a head at a lower end thereof, such as golf clubs and similarly configured game implements. Even more particularly, the present invention relates to such methods that provide for custom fitting of a golf club or like game implement to an individual's anatomical size and playing technique and which allows for acquiring the fitting process of the game implement via the Internet, fax, through the mail or like communication methods.

B. Background

Golf is a popular game played worldwide by millions of amateurs and professionals. The object of the game is to complete a golf course in as few strokes as possible. Shooting lower scores is a result of consistently, shot after shot, striking the golf ball at the "sweet spot" of the club face toward the intended target with the appropriate distance. The sweet spot is located on the club head face directly forward of the head's center of gravity. Failure to hit the golf ball exactly at this sweet spot is likely to result in errant or misdirected travel of the golf ball (e.g., slicing or hooking of the ball) with improper distance. Generally, the further away from the sweet spot that the golf ball is struck, the more misdirected and shorter its travel will be in comparison to the intended target. Proper swing technique alone will not ensure striking the golf ball on the sweet spot or a low score for a particular hole or course. However, when proper swing technique is matched with golf clubs that are custom fit to that particular technique then the possibility of striking the golf ball on the sweet spot and scoring lower is greatly increased.

Properly custom fitted golf equipment will allow for a consistent return of the club face through impact with the golf ball swing after swing. Whereas improperly sized golf equipment can provide just the opposite condition, sending the golf ball off line with improper distance ultimately leading to more strokes per hole and higher total scores.

Presently, in order to obtain custom fitted golf clubs a golfer must go to an on-course golf pro shop or an off-course golf retail store. There are several drawbacks in regard to being custom fitted for golf clubs at these establishments.

The rules of golf allow for tremendous diversity in club head size, design and shaft attachment positions (especially for putter heads). For putters you can have heel shafted, center shafted, toe shafted and all positions in between. This shaft attachment location diversity alters the lie angle and playing length readings between club head models. Which is to say you can not fit with one particular model of club (for example a heel shafted putter) and expect those fitting numbers to be applicable in building a different model of club (for example a center or toe shafted putter). In fact with the current methods of custom fitting, an on-course golf pro shop or an off-course golf retail store would have to stock at least one of every model golf club by every manufacturer to properly custom fit an individual for a specific model, which does not even address having all of the lie angles and different lengths per model. This fitting inventory would be far too costly and impractical and would have to be updated each time a manufacturer released a new club design. On-course golf pro shops and off-course golf retail stores usually only carry a few of the most popular models (in terms of sales) by the most popular manufacturers. So it is highly possible to not find an on-course golf pro shop or an off-course golf retail store with the specific club model that one would like to be fit for and purchase.

Assuming an individual has researched and found an on-course golf pro shop or an off-course golf retail store that has the specific model desired in stock, usually a fitting appointment must be scheduled based on the availability of the fitter. Then the individual must travel to that place of business for the fitting (travel time and fuel costs) and the fitting itself may require paying a fee.

Assuming the conditions presented above are met, the quality and precision of the fitting is still dependant upon the knowledge, experience, skill and insight of the fitter. Additionally, if an individual decides to purchase a new model the next year from a different manufacturer that is dissimilar from his or her current club, the custom fitting process must start over.

Many of the same considerations that are required to properly fit a golf club to a golfer also apply to fitting similar game implements to a player who utilizes that implement while playing that sport. For instance, hockey players of all levels prefer to utilize a hockey stick, which also comprises a shaft with a club head at a lower end thereof, that is custom fitted to their anatomy and manner of swinging the hockey stick. Other sports may also utilize similarly configured game implements that are also, preferably and beneficially, fitted to the individual player of the game that uses that implement.

Therefore, what is needed is an improved method of custom fitting golf clubs and similarly configured game playing implements. The preferred method of custom fitting should allow the use of any golf club or similarly configured game playing implement (or any linear item having a centerline that can represent the above) as a fitting club and allow those fitting specifications to be transferable and usable for fitting and assembly of any other golf club or similarly configured game playing implement. The preferred method of custom fitting golf clubs or similarly configured game playing implements should eliminate the need to schedule an appointment with a fitter, travel to the place of fitting and pay any fitting fees. The preferred method of custom fitting golf clubs or similarly configured game playing implements should allow the individual to custom fit his or her self at his or her location and time of choosing utilizing his or her existing golf clubs or similarly configured game playing implements. The preferred method of custom fitting golf clubs or similarly configured game playing implements should be readily adaptable for distribution via the internet, fax, mail and or other forms of communication that do not require face-to-face interaction.

SUMMARY OF THE INVENTION

The method of custom fitting a golf club or like game implement of the present invention provides solutions to the problems identified above. That is to say, the present invention discloses a method of custom fitting golf clubs and similarly configured game implements that can be utilized by the player to properly fit any model or style of golf club or like game implement with a single fitting. Because the method of the present invention allows the player to utilize his or her existing golf clubs or like game implements for the fitting and apply the fitting specifications found to any model or style of golf club or like game implement, the limitation of having to be fit with the specific golf club model the golfer wants to purchase is removed. In fact, as long as the player's swing characteristics remain the same, the specifications derived from a single fitting will allow for the assembly of different models and styles of game implements (through the use of a conversion angle which is defined as the difference in angle between the present invention's utilization and placement of the fitting shaft's centerline compared to the known shaft insertion point of a particular club head design), thereby allowing the player to change the model and style of his or her golf club or like implement without requiring a new fitting. Because the method of the present invention is adaptable for distribution over the Internet or via other forms of communication that do not require a face-to-face meeting, the requirement for the player to travel to a pro shop or store to be fitted is eliminated, thereby allowing the player to fit the implement at his or her home, office or other location of their choosing and at the day and time which is most convenient for the player, as opposed to when the shop or store is open and the fitter is available, thereby significantly easing the player's process of obtaining a properly fitted golf club or like game implement.

In one aspect of the present invention, the method of custom fitting golf clubs and like implements generally comprises the steps of selecting a fitting club or other implement to fit with, identifying and extending the centerline of the implement's shaft to the base or sole of the club head, the golfer assuming his or her preferred setup/address position while aligning the club face of the club head with the baseline of a universal setup mat while at the same time being sure the extended centerline of the shaft points to a target line on the mat, and then utilizing a lie angle protractor on the mat to determine the proper lie angle of the shaft. Initially, the player or someone on his or her behalf attaches a pointing device to the shaft with an attachment mechanism, such as tape or the like, such that a projected point of the pointing device is aligned with the centerline of the shaft to extend the centerline of the shaft to the sole of the club head. The mat is placed on a flat surface, typically a floor or floor-like surface, and the lower portion of the mat is secured to the floor with tape or other securing mechanisms. The mat has a baseline, fold line, target line and lie angle protractor, comprised of a plurality of angle lines projecting from the intersection of the fold line and target line and a plurality of angle markers marking the angles of the angle lines relative to the fold line as zero degrees. The target line of the mat represents the position on a golf ball where the sweet spot of the club face should contact the golf ball. The lie angle protractor portion of the mat is folded upward to be generally perpendicular to the floor by folding the mat at the fold line. The club head is placed adjacent to the baseline of the mat, with the club face thereof aligned with the baseline, and the projected point of the pointing device to point to the target line. For visual clarity, the club head may need to be slid along the lower portion of the mat until the shaft is at or near (i.e., generally adjacent) the lie angle protractor of the mat. The lie angle is read off of the protractor. Preferably, multiple measurements are made and the average thereof is utilized as the lie angle.

The method of the present invention determines a true playing length by marking a measuring line on a handle of the shaft (or the shaft itself) and then measuring the length by aligning a measuring tool, such as a tape measure, yard stick or the like, with the centerline of the shaft along either the face side or back side of the implement. The distance is measured from a zero point that is defined by intersecting the shaft's extended centerline with the surface supporting the sole of the club head.

The method of the present invention is also utilized to determine a proper grip size/model for the handle of the shaft. In the preferred embodiment, a grip size number is found by utilizing a hand size chart that has a crease line, a finger line perpendicular to the crease line and a sizing chart having a plurality of grip size numbers. The sizing chart is disposed along the finger line, which extends upward from the crease line through the middle finger of a hand printed on the chart. The grip size number is used to find a grip model on a grip model chart having a plurality of grip models identified by the grip size number.

Accordingly, the primary objective of the present invention is to provide a method of custom fitting golf clubs and like game implements that provides the advantages discussed above and overcomes the disadvantages and limitations which are associated with presently available methods of custom fitting such game implements.

An important objective of the present invention is to provide an improved method of custom fitting golf clubs and like game implements that allows the player to obtain a single fitting which is useable for all or virtually all models and styles of golf clubs and similarly configured game implements, including hockey sticks and the like, thereby eliminating the need to obtain a new fitting for each different model or style of game implement.

It is also an important objective of the present invention to provide an improved method of custom fitting game implements that is adaptable to golf clubs, hockey sticks and similarly configured game implements that can be fitted to a player's particular anatomy and swing.

It is also an important objective of the present invention to provide an improved method of custom fitting golf clubs and like game implements that utilizes the centerline of the shaft of the game implement as a constant which allows the player to fit with and be fitted to any model and/or style of game implement.

It is also an important objective of the present invention to provide a method of custom fitting golf clubs and similarly configured game implements that eliminates the need for the player to be fitted by a pro shop or retail store fitter and which allows the player to fit himself or herself in their home, office or other location of their choice and at a day and time of their choosing.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed text and drawings are merely illustrative of one or more preferred embodiments and, as such, disclose one or more different ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein show certain models and styles of golf clubs, as the game implement, those skilled in the art will readily understand that this is merely for purposes of simplifying the present disclosure and that the present invention is not limited to golf clubs or the models and styles of golf clubs shown.

Figure 14:
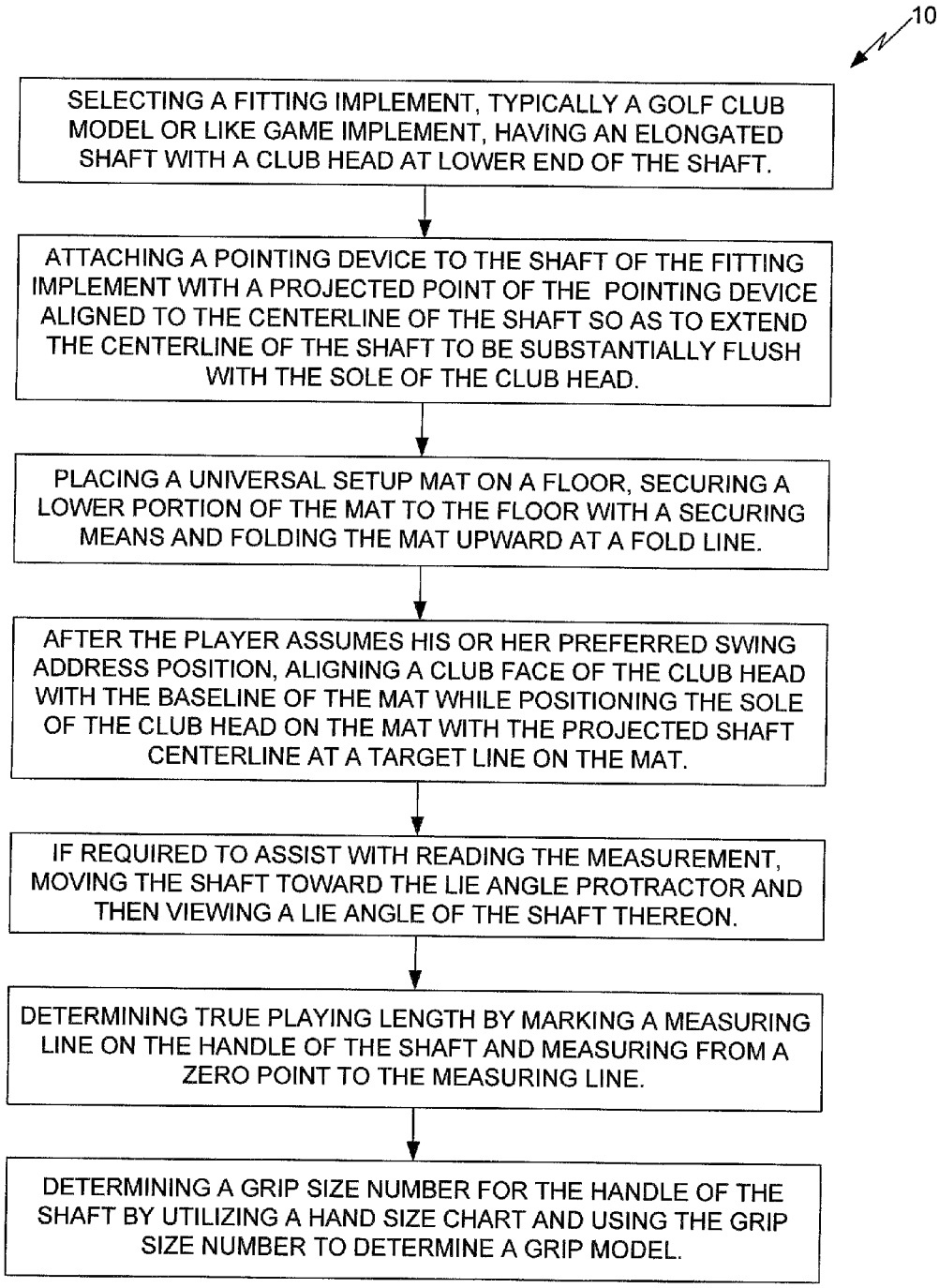
FIG. 14 is a flow chart summarizing the steps of custom sizing a golf club or other game implement of the present invention.

A method of custom fitting golf clubs and like game implements that comprises the steps and includes the components that are configured pursuant to a preferred embodiment of the present invention is shown generally as 10 in FIG. 14. As shown in FIGS. 1 through 4, a golf club 12 has an elongated shaft 14 and a club head 16 at the lower end 18 of shaft 14 opposite the shaft handle (shown as 74 in FIG. 6). As well known in the art, golf clubs 12 have club heads 16 that are configured in a wide variety of different sizes and shapes and with different shaft insertion points 20, which is the point at which the shaft 14 connects to the club head 16. The rules of golf allow golf clubs 12 to have different insertion points 20 and to have different lengths of the club head 16 from its heel 22 to its toe 24. A golf club head 16 has a club face 26 that contacts a golf ball to drive or putt the ball in the desired direction with desired distance (i.e., generally towards the cup or hole).

The golf club head's sweet spot, shown as 30 in FIGS. 1 through 4, is positioned on the club face 26 and is the desired location where the club face 26 should contact the golf ball when being struck by golf club head 16. While sweet spot 30 is generally located at the center of the club face 26, the exact location of sweet spot 30 is that position on the club face 26 which is directly forward of the center of gravity of golf club head 16. A strong solid hit of golf club 12 against a golf ball will generally encompass the entire area of sweet spot 30. It is at this location that, theoretically, the golf ball will travel the furthest and straightest. As set forth above, however, it is often difficult for a golfer to exactly contact the club face 26 against the golf ball at the sweet spot 30. As a result, the golf ball often travels in a direction that is not desired by the golfer. In addition to the misdirected travel, a golf ball will generally not travel as far when the sweet spot 30 is not hit directly against the golf ball. Generally, a similar issue exists for other sports where the game implement is directed against a game piece to direct the game piece in a desired direction, such as the head of a hockey stick against a puck.

Figure 4:
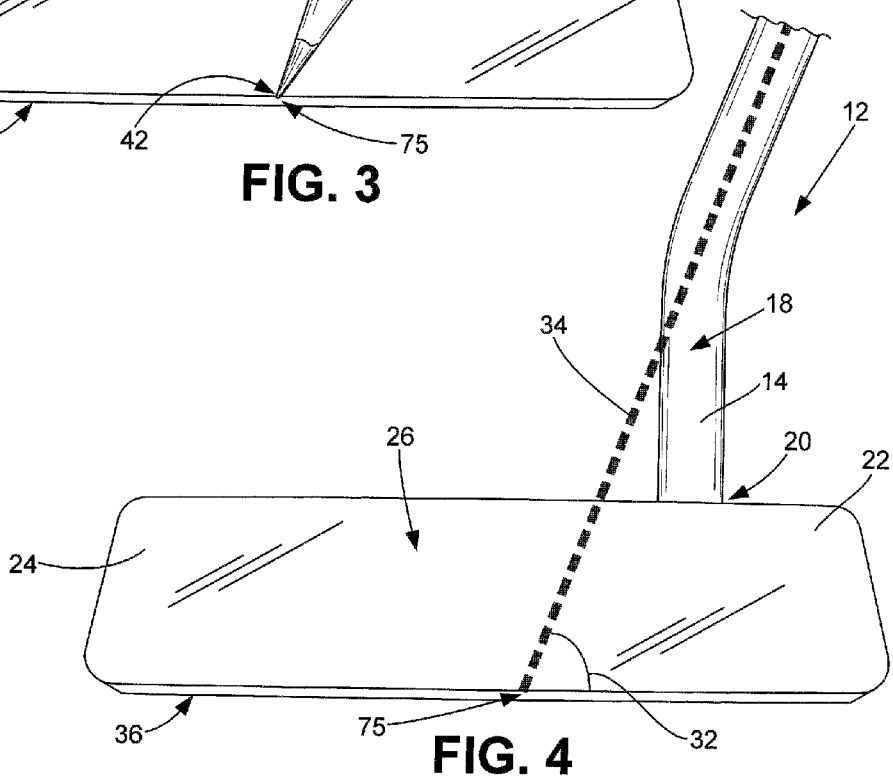
FIG. 4 is a face view of the golf club of FIG. 3 showing an imaginary line along the centerline of the shaft and intersecting the sole of the club head.

As known in the art, the lie angle 32 is the angle formed by the intersection of the centerline 34 of the shaft 14 and a line or plane through the sole 36 of the club head 16, as best shown in FIG. 4. As discussed above, presently available custom fitting techniques cannot properly fit a player to a golf club 12 unless the specific insertion point 20 and lie angle 32 are known, which limits the fitting solution to a particular model and style of golf club 12. The rules of golf allow tremendous diversity with regard to the design of club head 16 and the shaft insertion point 20. This diversity alters the lie angle 32 and length of shaft 14 between models and styles of golf club 12. A problem with prior art fitting methods is that they do not negate the variance in shaft insertion point 20 and design of the club head 16. As set forth in more detail below and summarized on FIG. 14, the fitting method 10 of the present invention negates these variances by utilizing the centerline 34 of the shaft 14.

The first primary step in the method 10 of the present invention is to select a golf club 12 or other game implement having an elongated shaft 14 as a fitting implement and then identify and extend the centerline 34 of the shaft 14 of the fitting implement (i.e., golf club 12) to the sole 36 of the club head 16. This is achieved by first selecting a golf club 12, such as a putter shown in the figures or nearly any linear item with a centerline (a telescopic antenna, broom stick, etc.), that the player is most comfortable with in regard to the length of the shaft 14. At this point, the lie angle 32, insertion point 20 and the design of the club head 16 are not important. The player (or someone on his or her behalf) then selects a pointing device 38, such as the pencil shown in FIG. 3. Alternatively, the pointing device 38 can be a pen, laser pointer or any other device capable of directing a point downward, as described below. The pointing device 38 is then attached to the shaft 14, with an attachment mechanism 40, such that a projected point 42 of the pointing device 38 disposed in direct alignment with the centerline 34 of the shaft 14. In the embodiment shown in FIG. 3, the pointing device 38 (pencil) is attached to the shaft 14 using one or more pieces of tape as the attachment mechanism 40. As will be readily apparent to those skilled in the art, however, the attachment mechanism 40 can be a wide variety of different mechanisms that are selected as being suitable for the material of shaft 14 and pointing device 38, such as magnets or the like.

Figure 1:
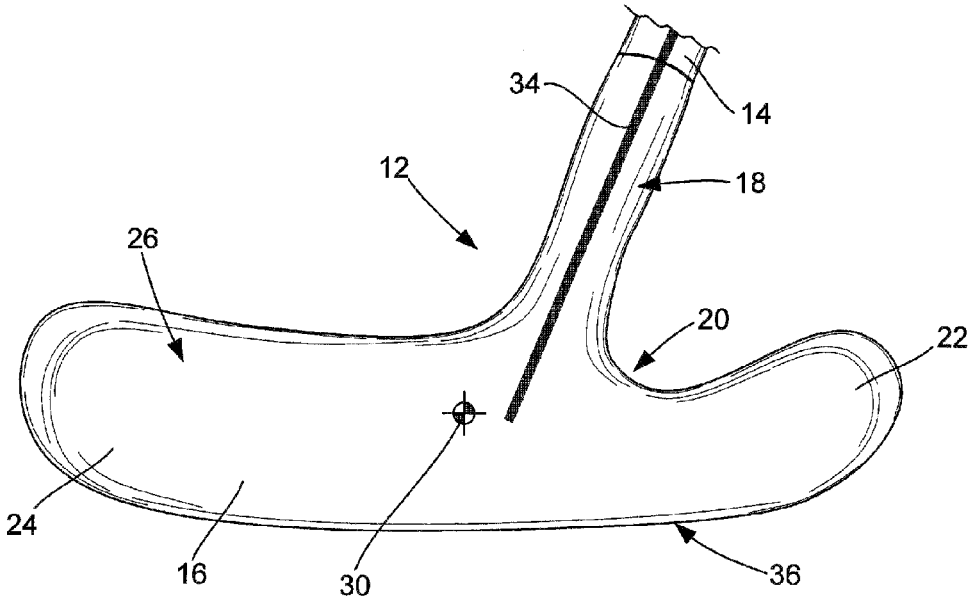
FIG. 1 is a face view of the lower end of a golf club showing the identification of the centerline of the shaft in relationship to the sweet spot for utilizing the method of the present invention to custom fit the model/style of the golf club to the player.
Figure 2:
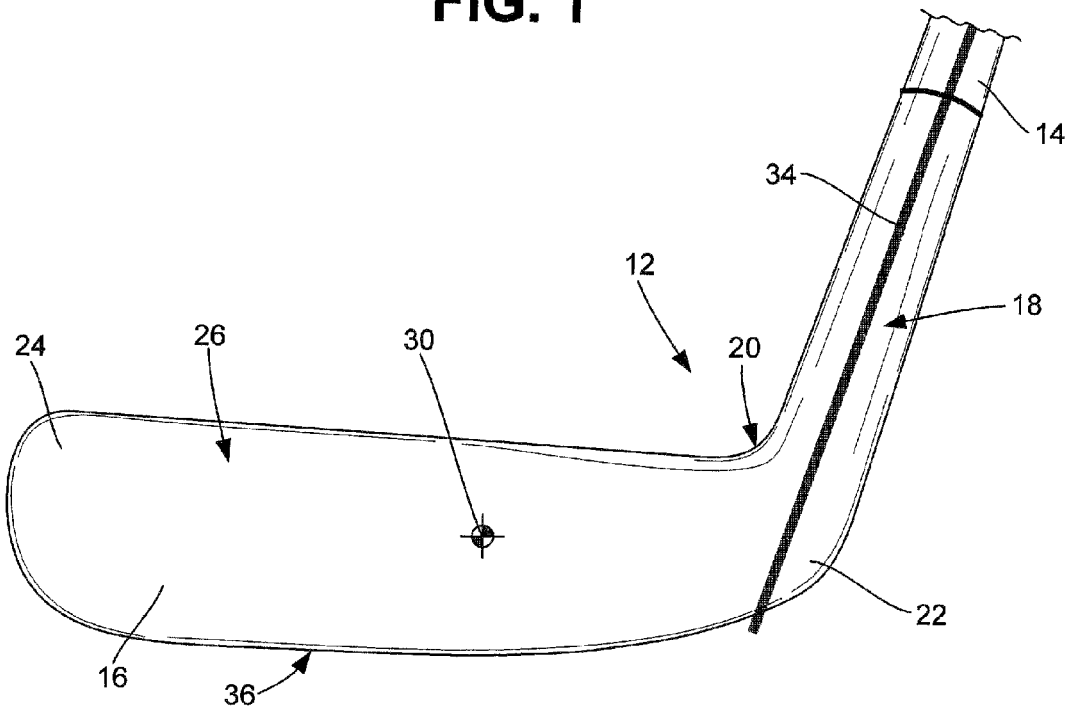
FIG. 2 is a face view of the lower end of a different model/style of golf club showing identification of the centerline of the shaft in relationship to the sweet spot for utilizing the method of the present invention.
Figure 3:
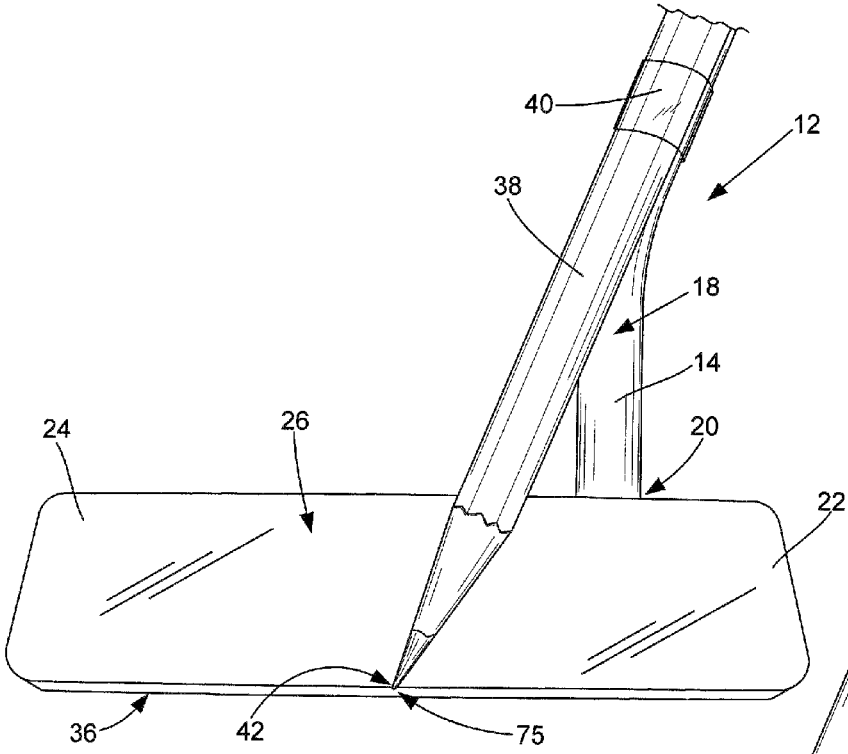
FIG. 3 is a face view of the lower end of a different model/style of golf club showing the use of a pencil attached to the shaft to identify the extended shaft centerline and it's relationship to the sole of the club head.

In a preferred embodiment, the player attaches the pointing device 38 to the shaft 14 with attachment mechanism 40 by laying the golf club 12 on a flat surface, such as a table, floor or the like, with the club face horizontal to the surface, aligning the attachment mechanism 40 with the centerline 34 of the shaft 14 and then securing pointing device 38 to shaft 14 with attachment mechanism 40. The pointing device 38 is attached such that the projected point 42 is substantially flush with the sole 36 of the club head 16, as shown in FIG. 3. In securing the pointing device 38 to the shaft 14, it is important for the player to maintain the alignment between pointing device 38 and shaft 14 such that the projected point 42 is along the centerline 34 of the shaft at or near the sole 36 of the golf club head 16.

Figure 5:
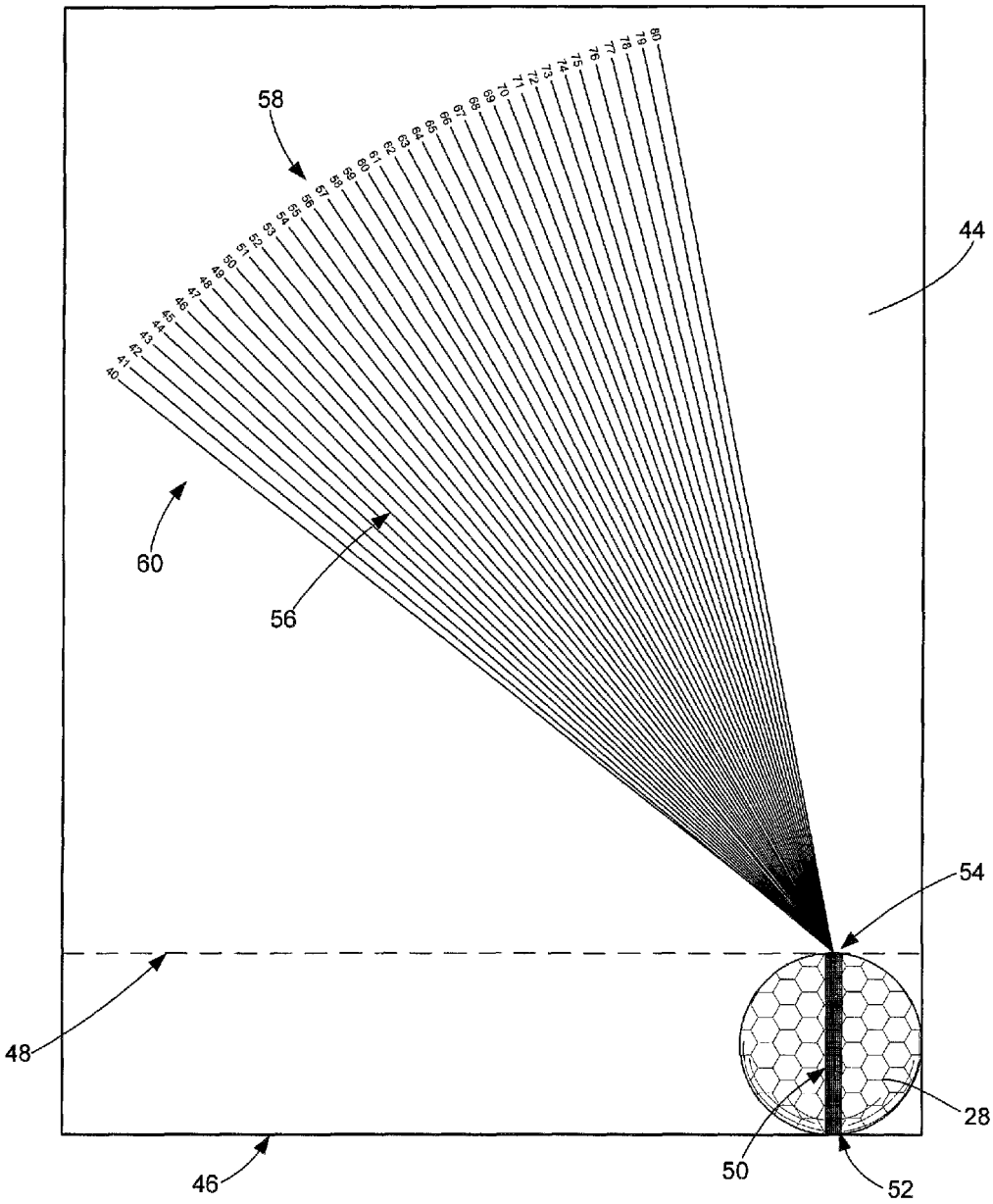
FIG. 5 is a top view of a universal setup mat that is utilized with the preferred method of the present invention to determine a desired lie angle.

The second primary step in the method 10 of the present invention utilizes the universal setup mat 44 shown in FIG. 5. As shown, the mat 44 has a baseline 46, a fold line 48, a picture representation of a golf ball (shown as 28), a target line 50 that extends through the center of golf ball 28 between the baseline 46 and the fold line 48, a first or base point 52 at the intersection of the target line 50 and baseline 46, a second or fold point 54 at the junction of target line 50 and the fold line 48 opposite the base point 52, a plurality of angle lines 56 extending outwardly from the fold point 54 and angle markers 58 at the ends of the angle lines 56 indicating the angle of each angle line 56 relative to the fold line 48, as the position for 0° and a line extending outward from the target line 50 being 90°. As will be appreciated by those skilled in the art, the target line 50 represents the midline of a golf ball where it is desired to contact the ball with the sweet spot 30 of the club head 16. The various angle lines 56 and angle line markers 58 define a lie angle protractor 60 that will be utilized to determine the desired lie angle 32 for the player. The player folds the mat 44 along the fold line 48, being as precise as possible to achieve an accurate lie angle fitting, and then positions mat 44 for the lie angle determination. The mat 44 is folded at fold line 48 to form a crease that will be utilized in a later step to place the lie angle protractor 60 against the shaft 14 of a golf club 12. In a preferred embodiment, the player places mat 44 on a smooth floor or other flat surface, shown as 62 in FIG. 10, and then places tape or other securing devices 63 across the edges of mat 44 between baseline 46 and fold line 48 substantially adjacent to the fold line 48 in a manner that allows the lie angle protractor 60 portion of mat 44 to be folded upward. The mat 44 should be secured to the floor or other flat surface 62 in a location where there will be ample room for the player to move around mat 44 and utilize it to determine his or her lie angle 32.

Figure 7:
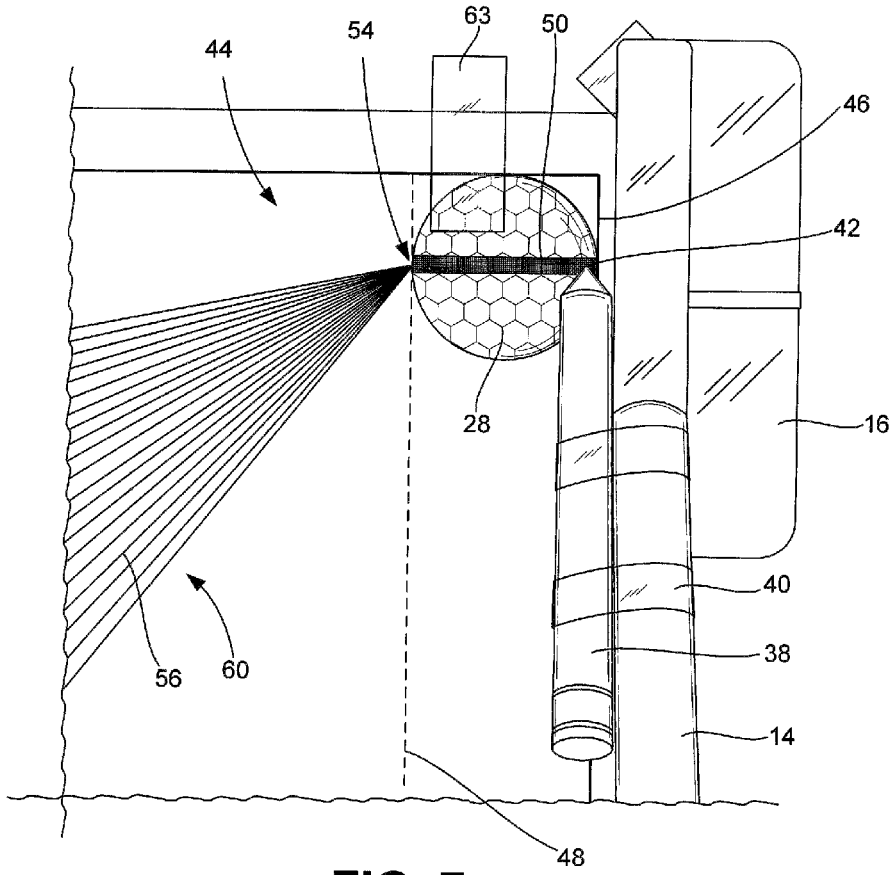
FIG. 7 is a top view of a golf club head having its club face aligned with the baseline of the mat of FIG. 5.

The third primary step, which is the setup step, in the method 10 of the present invention is to set the golf club 12 on the mat 44 or flat surface 62 on which the mat 44 is placed next to the printed golf ball 28 such that the club face 26 is aligned with the baseline 46 of mat 44 and the extended centerline 34 of the shaft 14 (identified by projected point 42) is at the target line 50 of the printed ball 28, as shown in FIG. 7. More specifically, the projected point 42 of the pointing device 38 should point the target line 50, while the club face 26 and baseline 46 are aligned. For performing this step of method 10, the player should wear generally flat soled "fitting" shoes, meaning that the thickness of the soles of these shoes are as close to the same thickness as the soles of his or her golf shoes without the spikes (which are normally sunk into the turf while golfing). The fitting shoes should be selected to most simulate being on the golf course in order to avoid changing the player's height, which will affect the lie angle 32 and the length of the shaft 14. The player's setup technique during the fitting session, including grip, posture, ball position and eye alignment, should be the same as when striking the ball on the golf course.

Figure 8:
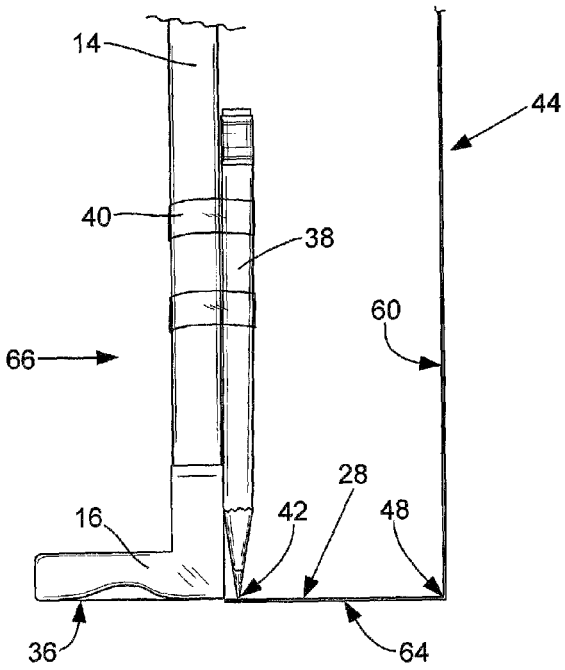
FIG. 8 is a toe view of a golf club head aligned to the baseline of the mat of FIG. 5 shown bent at the fold line with the line angle protractor extending upward from the floor.
Figure 9:
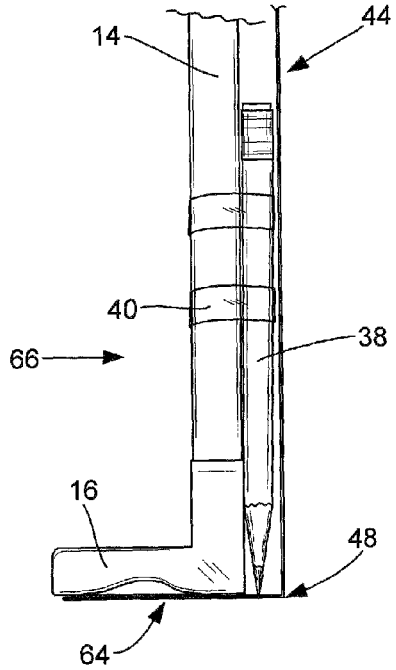
FIG. 9 is a toe view of a golf club head moved closer to the lie angle protractor of the mat from FIG. 8.
Figure 10:
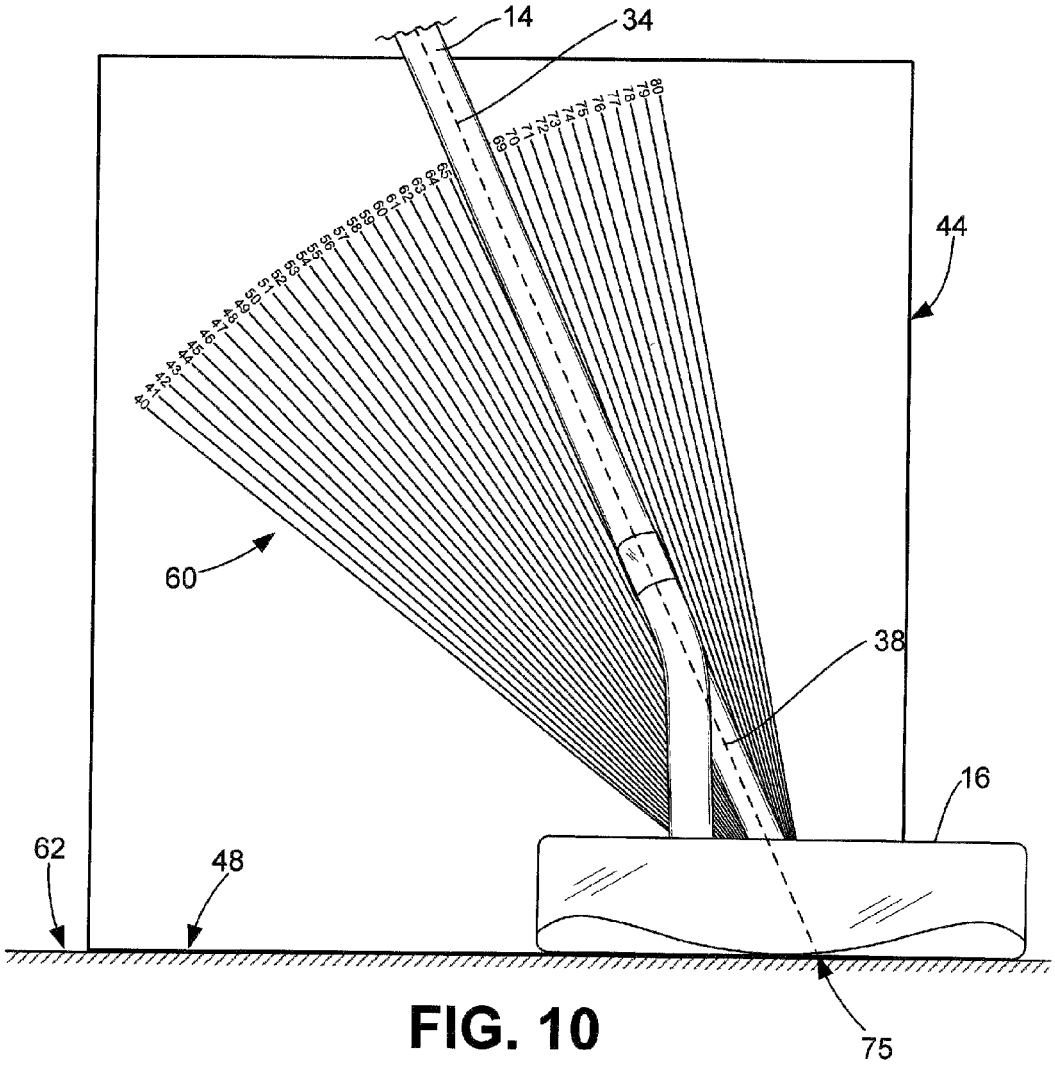
FIG. 10 is a back view of a golf club head and shaft placed near the lie angle protractor of the mat from FIG. 5 as viewed from the viewing angle to determine the lie angle.
Figure 11:
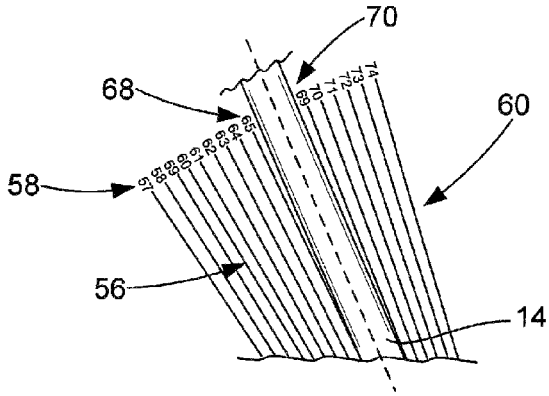
FIG. 11 is a closeup back view of the shaft positioned among the angle lines and angle markers of the lie angle protractor of FIG. 5.

The fourth primary step, which is the fitting step, of the method of the present invention is to determine the lie angle 32 itself. While in the ball striking position of the third step, with the club face 26 at baseline 46 and the projected point 42 at target line 50 the player will have his or he assistant fold the portion of mat 44 having the lie angle protractor 60 upward at the fold line 48 so that it is parallel to the shaft 14 of golf club 12, as shown in FIG. 8. For visual clarity, the assistant can slide the club head 16 across the lower portion 64 of the mat 44, the lower portion 64 being the area between fold line 48 and baseline 46, until club head 46 is in abutting relation with the lie angle protractor 60 that is extending upward, as shown in FIG. 9. The amount and direction of movement will depend on the amount of offset between the shaft 14 and the club face 26. The assistant then views the relationship between the shaft 14 and the lie angle protractor 60 from the viewing angle 66, which will be from the back of the club head 16 opposite the club face 26, as shown in FIG. 10. From viewing angle 66, the assistant will see an angle marker 58 on each side of the shaft 14, as shown in FIG. 11, identified as first angle marker 68 (the number "65" shown on the protractor 60) and second angle marker 70 (identified as the number "69" on protractor 60). The numbers of the first 68 and second 70 angle markers are added together and then the sum is divided by two to find the lie angle 32 (i.e., in the example, 65+69=134; 134/2=67.0). While still in the setup position, have the assistant mark a measuring line 72 on the handle 74 or the shaft 14, shown marked in FIG. 6, at a point which is directly across from the highest point of the wrist crease of the upper hand while the player is gripping the handle 74 each time a new setup is performed. In a preferred embodiment of the present method, the player should go through the setup and fitting process multiple times (e.g., at least five times) to obtain the most accurate reading possible. After each fitting the player should stand erect, ungrip the handle 74 and move away from the mat 44 prior to beginning the next setup and fitting process. The user adds the lie angles 32 determined from each setup/fitting process together and then divides the total by the number of setup/fitting processes (i.e., five) to obtain an average lie angle 32. This average lie angle 32 will best represent the player's preferred lie angle 32.

The fitting step described above utilizes the lie angle protractor 60 as the preferred angle finding means. In part, use of the lie angle protractor 60 as the angle finding means for finding the lie angle 32 is preferred due to the ability to make the mat 44, having lie angle protractor 60, available over the Internet or through the mail or by other communication methods that do not require the player to have a face-to-face meeting or purchase of any other equipment. If preferred, however, the angle finding means can be virtually any mechanical, electronic or other type of angle finder, such as a magnetic angle finder, a bubble level or a wide variety of other types of angle finding means. As is achieved with use of the lie angle protractor 60 set forth above, any mechanical or other type of angle finding means that is placed against, attached to or otherwise utilized with shaft 14 to find the lie angle 32 must be utilized at the portions of the shaft 14 parallel to the extended centerline, as opposed to the tapered portion of the shaft 14, to obtain the proper angle reading.

Figure 6:
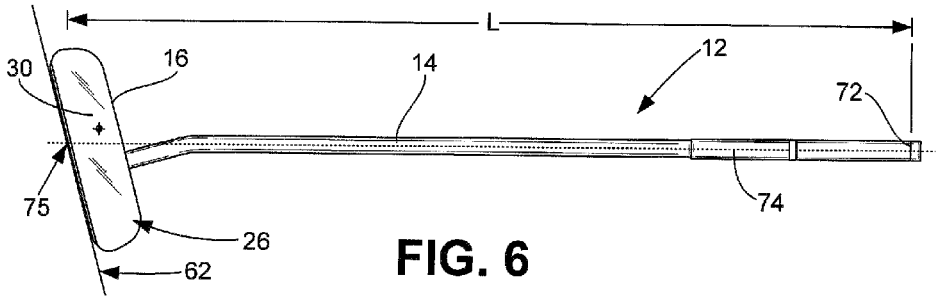
FIG. 6 is a face view of a golf club showing the true playing length as determined by the method of the present invention.

Once the lie angle 32 is obtained, the fifth primary step is for the player to determine his or her true playing length L for golf club 12, as shown on FIG. 6. The player or the assistant measures the true playing length L utilizing a measuring tool, such as a tape measure, yardstick or the like. The zero point 75 for measuring the true playing length L is where the centerline 34 of the shaft 14 intersects the mat 44 or the floor 62 or other flat surface supporting the sole 36 of golf club 12, as shown on FIGS. 3, 4 and 6. The measuring of the true playing length L is done with the golf club 12 repositioned into the player's average lie angle setup position (described above). The measuring tool is placed on the face side 26 or back side of club head 16 with the start of the measuring tool at the zero point 75, set forth above, and aligned parallel to and along the centerline 34 of shaft 14. The player measures the length from zero point 75 to measuring line 72 (i.e., the grip or shaft mark made earlier) and records this measurement. As with the determination of lie angle 32, preferably the player measures the true playing length L multiple times, adds the lengths L together and then divides the sum by the number of measurements to obtain an average true playing length L.

Figures 12, 13:
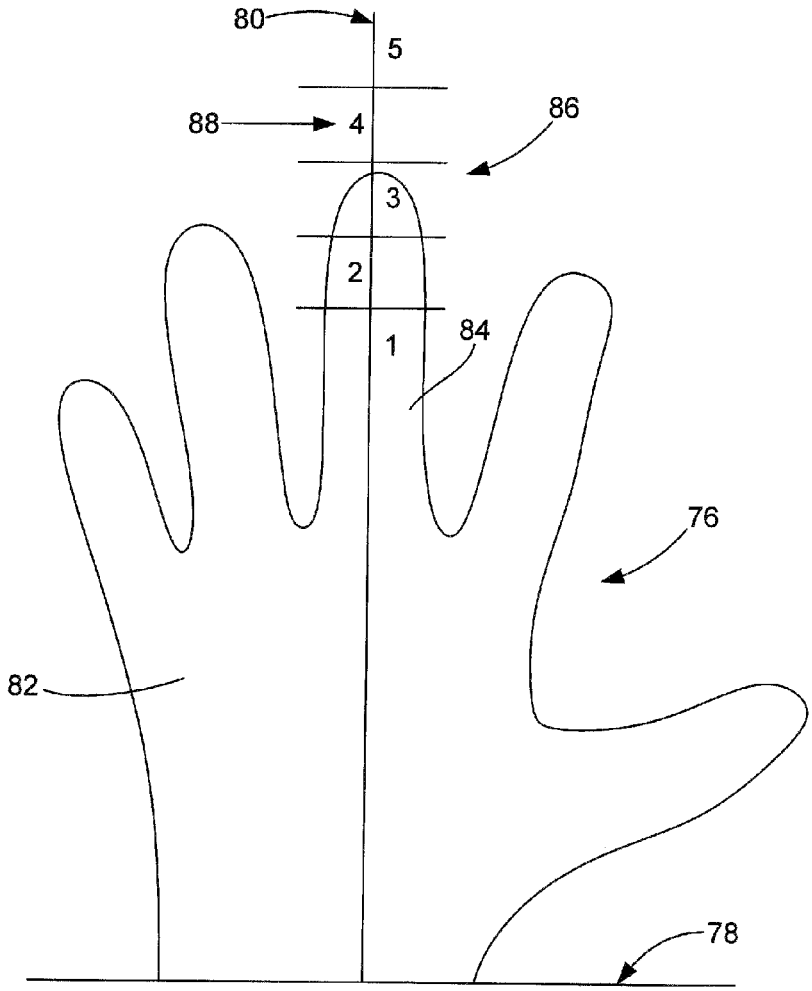
FIG. 12 is a top view of a hand size chart for use with the method of the present invention to determine the player's preferred grip size.
FIG. 13 is a top view of a grip model chart that is utilized with the hand size chart of FIG. 12 to identify a preferred grip model.

The sixth primary step for the custom fitting method 10 of the present invention is to determine the appropriate grip size. To assist the player with finding his or her proper grip size, a hand size chart 76 (shown in FIG. 12), can be supplied to the player. As shown, the hand size chart 76 has a horizontally disposed crease line 78, a vertically disposed finger line 80 that is in perpendicular relation with the crease line 78 and a hand outline 82 that has the finger line 80 centered through the middle finger 84 thereon. The hand size chart 76 also includes a sizing chart 86, having a plurality of size numbers 88, along the finger line 80 beginning with at a point approximately two-thirds the distance up the middle finger 84 of the hand outline 82. The player uses the hand size chart 76 by placing his or her hand on the hand outline 82 with their palm side facing up or down from the hand size chart 76 and the wrist crease at the base of their hand at the crease line 78, thereby directing their middle finger along the finger line 80 through the middle finger 84 of the hand outline 82. The player notes the size number 88, which typically covers a range between numbers 88, on the sizing chart 86 in which the tip of their middle finger is positioned. Using the size number 88 obtained from the sizing chart 86 the player consults a grip model chart 90, such as shown in FIG. 13, that contains suggested grip models, shown as 92, based on the player's size number 88 (examples shown for putter grip models). The grip models 92 set forth on the grip model chart 90 are typically intended to be suggested grip models, with the player being free to choose whichever of the grip models 92 he or she desires. As with the universal setup mat 44, the hand size chart 76 and grip model chart 90 can be made available to the player over the Internet, through the mail or by other communication methods that do not require a face-to-face meeting with a fitter or other store person.

The above described method 10 is summarized on the flow chart of FIG. 14. With the lie angle 32, true playing length L and the grip model 92 information, the player can then proceed to an assembly options page (i.e., on the Internet), enter the information into a form and choose the golf club head model he or she wants to use in the creation of his or her custom made golf club 12. The information obtained by the method 10 of the present invention can be utilized with virtually any model and style of golf club 12. This same process can be utilized as part of a custom sizing program to size a hockey stick or other playing implement that has a shaft 14 and club head 16 and which is configured similar to golf club 12.

Due to the fact that the present invention utilizes the centerline of a shaft, one of the advantages of the method 10 is that the sizing information obtained is useful for the assembly or building of any golf club, independent of the location of the insertion point 20, the configuration of the lower end of the shaft 14 and the configuration of the club head 16. The lie angle 32 and true playing length L found utilizing the method 10 of the present invention is independent of club head 16 and, therefore, can be utilized for any configuration of club head 16. In contrast, presently available mechanical mechanisms utilized to determine the lie angle are dependent on the configuration of a particular model of club head 16 and the insertion point 20. This results in the prior art lie angle determinations and lengths being only useful for that particular model and style of golf club 12. Naturally, such determinations are not adaptable or useful with custom sizing over the Internet or other sizing methods that do not use face-to-face meeting with a fitter or other person knowledgeable in fitting technology.

Various alternative configurations of the various devices can work with the method 10 of the present invention. For instance, the target line 50 can be just a dot or just the space between the base point 52 and the fold point 54. The lie angle protractor 60, described above in chart form, can be an actual protractor or like device that is provided to the player or which he or she has in their possession.

While there are shown and described herein a specific form of the invention, it will be readily apparent to those skilled in the art that the invention is not so limited, but is susceptible to various modifications and rearrangements in design and materials without departing from the spirit and scope of the invention. In particular, it should be noted that the present invention is subject to various modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. A method of custom fitting a game implement, said method comprising the steps of:

a) selecting a fitting implement having an elongated shaft with a club head at a lower end of said shaft;

b) attaching a pointing device to said shaft, said pointing device defining a projected point aligned with a centerline of said shaft so as to extend said centerline to be substantially flush with a sole of said club head;

c) placing a mat on a flat surface, said mat having a baseline, a fold line, a target line and a lie angle protractor, said target line and said baseline defining a base point and said target line and said fold line defining a fold point;

d) aligning a club face of said club head with said baseline while pointing said projected point at said target line and having said sole of said club head against said mat on said flat surface;

e) folding said mat upward to dispose said lie angle protractor generally parallel to said shaft before or after said aligning step; and f) viewing a lie angle of said shaft on said lie angle protractor and determining said lie angle of said game implement.

2. The method of claim 1 further comprising the step of:

g) determining a true playing length by marking a measuring line on a handle of said shaft or on said shaft itself and measuring said true playing length by aligning a measuring tool with said centerline of said shaft and measuring from a zero point to said measuring line, said zero point defined by intersecting said centerline with said mat or said flat surface on which said sole of said club head is positioned.

3. The method of claim 2 further comprising the step of:

h) determining a grip size number for said handle by utilizing a hand size chart having a crease line, a finger line perpendicular to said crease line and a sizing chart, said sizing chart disposed along said finger line.

4. The method of claim 3 further comprising the step of:

i) finding a grip model by using said size number and referencing a grip model chart.

5. The method of claim 3, wherein said hand size chart comprises a hand outline having a middle finger aligned with said finger line for placement of a player's hand and middle finger.

6. The method of claim 1 further comprising the step of:

g) determining a grip size number for a handle by utilizing a hand size chart having a crease line, a finger line perpendicular to said crease line and a sizing chart, said sizing chart disposed along said finger line.

7. The method of claim 6 further comprising the step of:

h) finding a grip model by using said size number and referencing a grip model chart.

8. The method of claim 1 further comprising an attachment means for attaching said pointing device to said shaft in said attaching step.

9. The method of claim 1 further comprising a securing means for securing said mat to a floor in said placing step.

10. The method of claim 1 further comprising the step of moving said shaft generally toward said lie angle protractor if required for visual clarity.

11. The method of claim 10, wherein said moving step comprises sliding said sole of said club head across a lower portion of said mat.

12. A method of custom fitting a game implement, said method comprising the steps of:

a) selecting a fitting implement having an elongated shaft with a club head at a lower end of said shaft;

b) attaching a pointing device to said shaft with a means for attaching said pointing device to said shaft, said pointing device defining a projected point aligned with a centerline of said shaft so as to extend said centerline to be substantially flush to a sole of said club head;

c) securing a lower portion of a mat to a floor, said mat having a baseline, a fold line, a target line and a lie angle protractor, said target line and said baseline defining a base point and said target line and said fold line defining a fold point;

d) aligning a club face of said club head with said baseline while pointing said projected point at said target line and having said sole of said club head against said mat on said flat surface;

e) folding said mat upward to dispose said lie angle protractor generally parallel to said shaft before or after said aligning step;

f) if required for visual clarity, sliding said shaft generally toward said lie angle protractor;

g) viewing a lie angle of said shaft on said lie angle protractor and determining said lie angle of said game implement; and h) determining a true playing length by marking a measuring line on a handle of said shaft or on said shaft itself and measuring said true playing length by aligning a measuring tool with said centerline of said shaft and measuring from a zero point to said measuring line, said zero point defined by intersecting said centerline with said mat on which said sole of said club head is positioned.

13. The method of claim 12 further comprising the step of:

i) determining a grip size number for said handle by utilizing a hand size chart having a crease line, a finger line perpendicular to said crease line and a sizing chart, said sizing chart disposed along said finger line.

14. The method of claim 13 further comprising the step of:

j) finding a grip model by using said size number and referencing a grip model chart.

15. The method of claim 13, wherein said hand size chart comprises a hand outline having a middle finger aligned with said finger line for placement of a player's hand and middle finger.

16. A method of custom fitting a game implement, said method comprising the steps of:

a) attaching a pointing device to an elongated shaft of a fitting device with a means for attaching said pointing device to said shaft, said pointing device defining a projected point aligned with a centerline of said shaft so as to extend said centerline to be at least substantially flush to a sole of a club head at a lower end of said shaft;

b) securing a lower portion of a mat to a floor, said mat having a baseline, a fold line, a target line and a lie angle protractor, said target line and said baseline defining a base point and said target line and said fold line defining a fold point;

c) aligning a club face of said club head with said baseline while pointing said projected point at said target line and having said sole of said club head against said mat on said flat surface;

d) folding said mat upward to dispose said lie angle protractor generally parallel to said shaft before or after said aligning step;

e) if required for visual clarity, sliding said shaft generally toward said lie angle protractor;

f) viewing a lie angle of said shaft on said lie angle protractor and determining said lie angle of said game implement; and g) determining a grip size number for a handle by utilizing a hand size chart having a crease line, a finger line perpendicular to said crease line and a sizing chart, said sizing chart disposed along said finger line.

17. The method of claim 16 further comprising the step of:

h) finding a grip model by using said size number and referencing a grip model chart.

18. The method of claim 16 further comprising the step of:

h) determining a true playing length by marking a measuring line on said handle of said shaft or on said shaft itself and measuring said true playing length by aligning a measuring tool with said centerline of said shaft and measuring from a zero point to said measuring line, said zero point defined by intersecting said centerline with said mat or said flat surface on which said sole of said club head is positioned.

19. The method of claim 18 further comprising the step of:

i) finding a grip model by using said size number and referencing a grip model chart.

* * * * *